US010440798B2

(12) United States Patent
Mao et al.

(10) Patent No.: US 10,440,798 B2
(45) Date of Patent: Oct. 8, 2019

(54) LED LAMP AND TEMPERATURE CONTROL CIRCUIT APPLIED THERETO

(71) Applicant: General Electric Company, Schenectady, NY (US)

(72) Inventors: Zhu Mao, Shanghai (CN); Zhangji Zhou, Shanghai (CN); Min Fang, Shanghai (CN); Fanbin Wang, Shanghai (CN); Shuyi Qin, Shanghai (CN)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 15/964,096

(22) Filed: Apr. 27, 2018

(65) Prior Publication Data

US 2018/0338356 A1 Nov. 22, 2018

(30) Foreign Application Priority Data

May 22, 2017 (CN) ..... 2017 1 0362912

(51) Int. Cl.
*H05B 33/08* (2006.01)

(52) U.S. Cl.
CPC ..... *H05B 33/089* (2013.01); *H05B 33/0809* (2013.01); *H05B 33/0884* (2013.01)

(58) Field of Classification Search
CPC ..... H05B 33/08; H05B 33/0809; H05B 33/0848; H05B 33/089
See application file for complete search history.

(56) References Cited

U.S. PATENT DOCUMENTS 5,321,337 A * 6/1994 Hsu ..... H05B 41/2856 315/219
5,365,162 A * 11/1994 Sundhar ..... H02M 5/257 323/320
2003/0057871 A1* 3/2003 Kominami ..... H05B 41/2855 315/224
2007/0019444 A1* 1/2007 Kasai ..... H02M 1/36 363/19

(Continued)

*Primary Examiner* — Jason Crawford
(74) *Attorney, Agent, or Firm* — Buckley, Maschoff & Talwalkar, LLC

(57) ABSTRACT

The present invention provides an LED lamp and a temperature control circuit applied to the LED lamp. The LED lamp includes at least one LED unit, a magnetic ballast, and an LED drive circuit. The magnetic ballast is coupled to a power and configured to limit and stabilize a received alternating current. The LED drive circuit includes a temperature control circuit. The temperature control circuit is coupled to the magnetic ballast and connected in parallel with the LED unit, is configured to detect an internal temperature of the LED lamp and adjust an output power of the LED unit, and includes a thermal sensitive module having a negative temperature coefficient thermistor and a phase cut circuit. The phase cut circuit is coupled to the thermal sensitive module, and adjusts the output power of the LED unit by decreasing a resistance of the negative temperature coefficient thermistor when the negative temperature coefficient thermistor detects that the internal temperature of the LED lamp is higher than a specified temperature threshold.

12 Claims, 5 Drawing Sheets

(56) References Cited

U.S. PATENT DOCUMENTS

| | | | | |
|---|---|---|---|---|
| 2009/0322237 | A1* | 12/2009 | Bobel | H05B 41/295 315/224 |
| 2010/0289418 | A1* | 11/2010 | Langovsky | H05B 33/0809 315/210 |
| 2013/0195479 | A1* | 8/2013 | Tsujihara | G03G 15/2007 399/33 |
| 2014/0138372 | A1* | 5/2014 | Ogura | G03G 15/2042 219/216 |
| 2014/0368130 | A1* | 12/2014 | Catalano | H05B 33/0884 315/309 |
| 2015/0208470 | A1* | 7/2015 | Lin | H05B 33/0845 315/201 |
| 2016/0249419 | A1* | 8/2016 | Wan | H05B 33/0815 |
| 2017/0311396 | A1* | 10/2017 | Sadwick | F21V 25/00 |

* cited by examiner

LED LAMP AND TEMPERATURE CONTROL CIRCUIT APPLIED THERETO

TECHNICAL FIELD

The present invention relates to a lighting application of a light-emitting diode (LED), and in particular, to a temperature control circuit of an LED lamp using a magnetic ballast.

BACKGROUND

As a new-generation light source, an LED has the advantages of energy saving, environmental protection, long life, diversified colors, stable beam, and high electro-optical conversion rate. It has become a trend to use the LED as a lighting source in recent years.

However, the LED light source still has some energy that cannot be converted into light energy and is discharged in a form of heat energy. When an LED lamp made from an LED light source is used to replace a fluorescent lamp or a high-pressure gas discharge lamp which requires great light intensity, if no power adaption adjustment function is provided based on an internal ambient temperature of the lamp, a large amount of heat energy will be generated inside the relatively closed lamp. Consequently, the internal temperature of the lamp is higher than a safe temperature. High temperatures may accelerate damage to the LED and reduce a service life of the LED lamp.

Therefore, it is necessary to provide a drive circuit that can adaptively reduce a drive current of the LED light source and reduce an output power and an internal temperature of the LED lamp when the internal ambient temperature of the LED lamp is excessively high, so as to realize the purpose of protecting the LED light source and extending a service life of the lamp.

A fluorescent light source or high-pressure gas discharge light source can be replaced with an LED light source via two methods. One is to develop a dedicated LED drive circuit specifically based on the characteristics of LED devices; and the other is to directly use a ballast that drives a fluorescent light source or high-pressure gas discharge light source to drive the LED light source. The ballast includes a magnetic ballast and an electronic ballast. The electronic ballast outputs a high-frequency current, while the magnetic ballast outputs a low-frequency current. However, the direct replacement may also cause the problem of an excessively high internal temperature of the lamp.

To meet this demand, it is necessary to provide a drive circuit that can extend a service life of an LED lamp while still using the original magnetic ballast.

SUMMARY

An aspect of the present invention provides an LED lamp. The LED lamp includes at least one LED unit, a magnetic ballast, and an LED drive circuit. The magnetic ballast is coupled to a power and configured to limit and stabilize a received alternating current. The LED drive circuit includes a temperature control circuit, and the temperature control circuit is coupled to the magnetic ballast and connected in parallel with the LED unit, and is configured to detect an internal temperature of the LED lamp and adjust an output power of the LED unit. The temperature control circuit includes a thermal sensitive module having a negative temperature coefficient thermistor and a phase cut circuit. The phase cut circuit is coupled to the thermal sensitive module, and adjusts the output power of the LED unit by decreasing a resistance of the negative temperature coefficient thermistor when the negative temperature coefficient thermistor detects that the internal temperature of the LED lamp is higher than a specified temperature threshold.

Another aspect of the present invention provides a temperature control circuit applied to an LED lamp. The temperature control circuit is coupled between a magnetic ballast and at least one LED unit, and includes a thermal sensitive module having a negative temperature coefficient thermistor and a phase cut circuit. The phase cut circuit is coupled to the thermal sensitive module, and adjusts an output power of the LED unit by decreasing a resistance of the negative temperature coefficient thermistor when the negative temperature coefficient thermistor detects that an internal temperature of the LED lamp is higher than a specified temperature threshold.

An objective of the present invention is to design a temperature control circuit that cooperates with a magnetic ballast to adaptively reduce a drive current of an LED light source and reduce an output power and an internal temperature of an LED lamp when the internal ambient temperature of the LED lamp is excessively high, so as to realize the purpose of protecting the LED light source and extending a service life of the lamp.

BRIEF DESCRIPTION OF THE DRAWINGS

The present invention will be better understood from the following description of embodiments of the present invention taken in conjunction with the accompanying drawings, in which.

DESCRIPTION OF EMBODIMENTS

Unless otherwise defined, the technical and scientific terms used in the claims and the specification are as they are usually understood by those skilled in the art to which the present invention pertains. "First", "second" and similar words used in this specification and in the claims do not denote any order, quantity or importance, but are merely intended to distinguish between different constituents. Similarly, the terms "one", "a" and the like are not meant to be limiting, but rather denote the presence of at least one. "Comprising", "consisting" and similar words mean that elements or articles appearing before "comprising" or "consisting" include the elements or articles and their equivalent elements appearing behind "comprising" or "consisting", not excluding any other elements or articles. "Connected", "coupled" and similar words are not restricted to physical or mechanical connections, but may include electrical connections, whether direct or indirect.

A "leading-edge phase cut circuit" refers to that a half cycle of an alternating current power starts from a phase of 0 degrees, a chopped voltage is input until a switch is turned on at a specified angle, and then the load is powered by voltages until the half cycle is ended. After zero voltage, the same operation is repeated.

A "trailing-edge phase cut circuit" refers to that a half cycle of an alternating current power starts from a phase of 0 degrees, a switch is turned on, and the load is powered by voltages until the switch is turned off at a specified angle and the state is kept until the half cycle is ended. After zero voltage, the same operation is repeated.

The present invention provides a temperature control circuit that cooperates with a magnetic ballast to adaptively reduce a drive current of an LED light source and reduce an output power and an ambient temperature when the internal ambient temperature of an LED lamp is excessively high, so as to realize the purpose of protecting the LED light source and extending a service life of the lamp.

Figure 1:
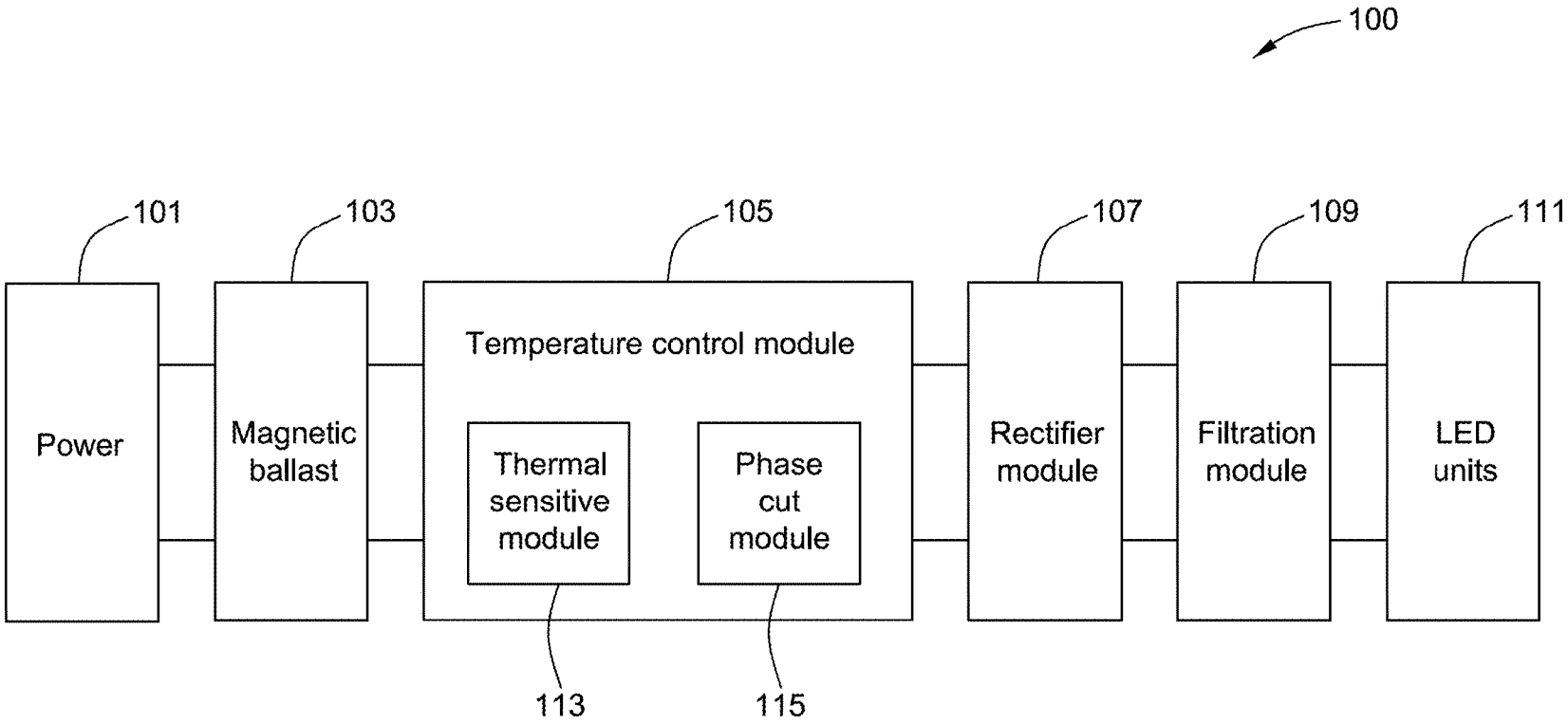
FIG. 1 is a schematic diagram of functional modules of an embodiment of an LED lamp according to the present invention.

FIG. 1 shows a schematic diagram of functional modules of an embodiment of an LED lamp according to an embodiment. An LED lamp 100 includes a magnetic ballast 103, a drive module, and an LED unit module 111, where the drive module includes a temperature control module 105, a rectifier module 107, and a filtration module 109. The magnetic ballast 103 is coupled to two ends of a power 101 and configured to limit and stabilize a received alternating current. The temperature control module 105 is coupled to two ends of the magnetic ballast 103 and connected in parallel with the LED unit module 111, and is configured to detect an internal temperature of the LED lamp 100 and adjust an output power of the LED unit module 111. The temperature control module 105 includes a thermal sensitive module 113 and a phase cut drive module 115. The phase cut drive module 115 is coupled to the thermal sensitive module 113, and adjusts the output power of the LED unit module 111 by decreasing a resistance of the thermal sensitive module 113 when the thermal sensitive module 113 detects that the internal temperature of the LED lamp 100 is higher than a specified temperature threshold, so as to reduce the internal temperature of the LED lamp 100. The rectifier module 107 is connected in parallel with the filtration module 109 and then coupled between the temperature control module 105 and the LED unit module 111, and is configured to convert an alternating current into a direct current to output to the LED unit module 111.

Figure 2:
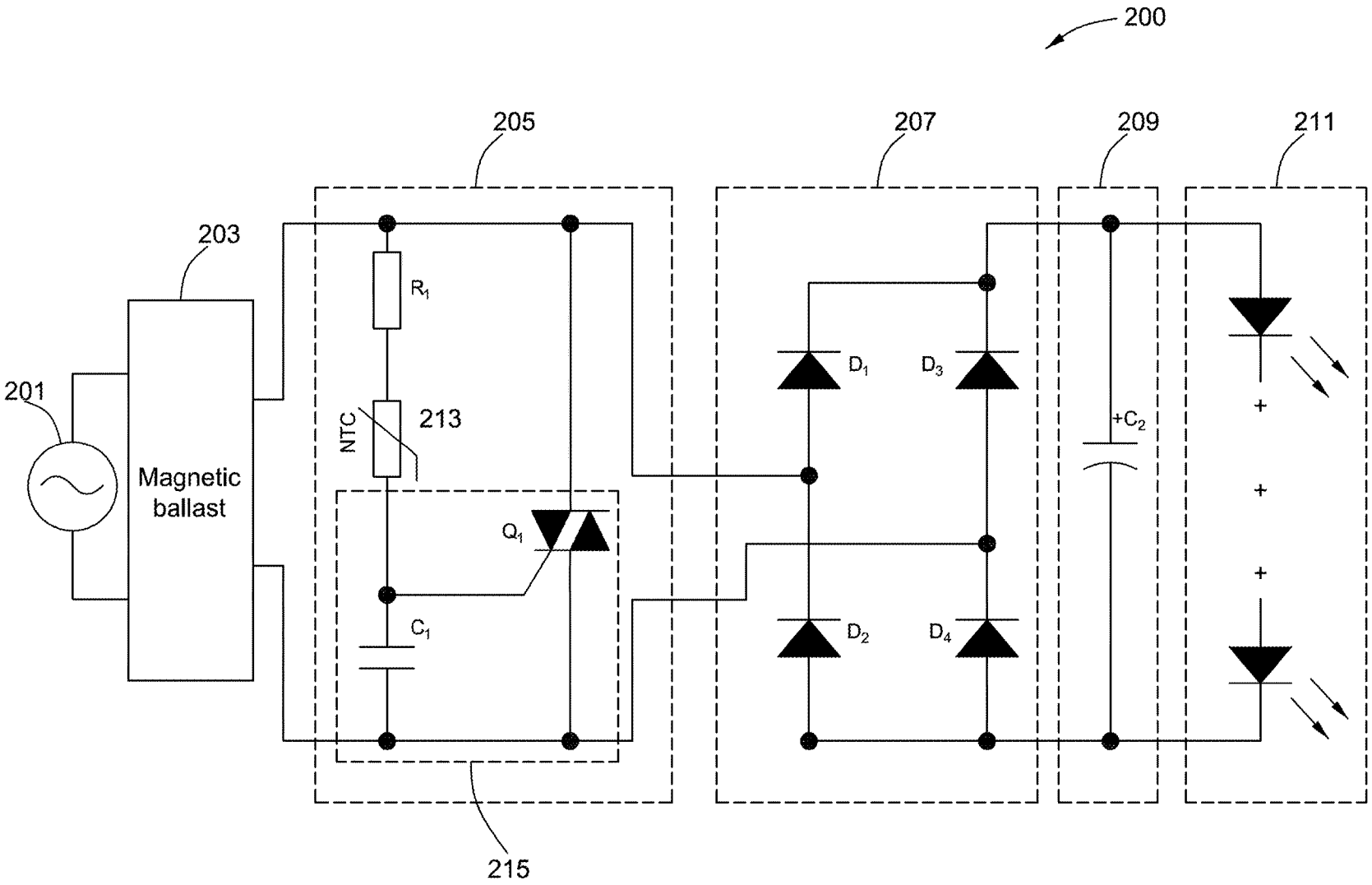
FIG. 2 is a circuit diagram of a first embodiment of an LED lamp according to the present invention.
Figure 4:
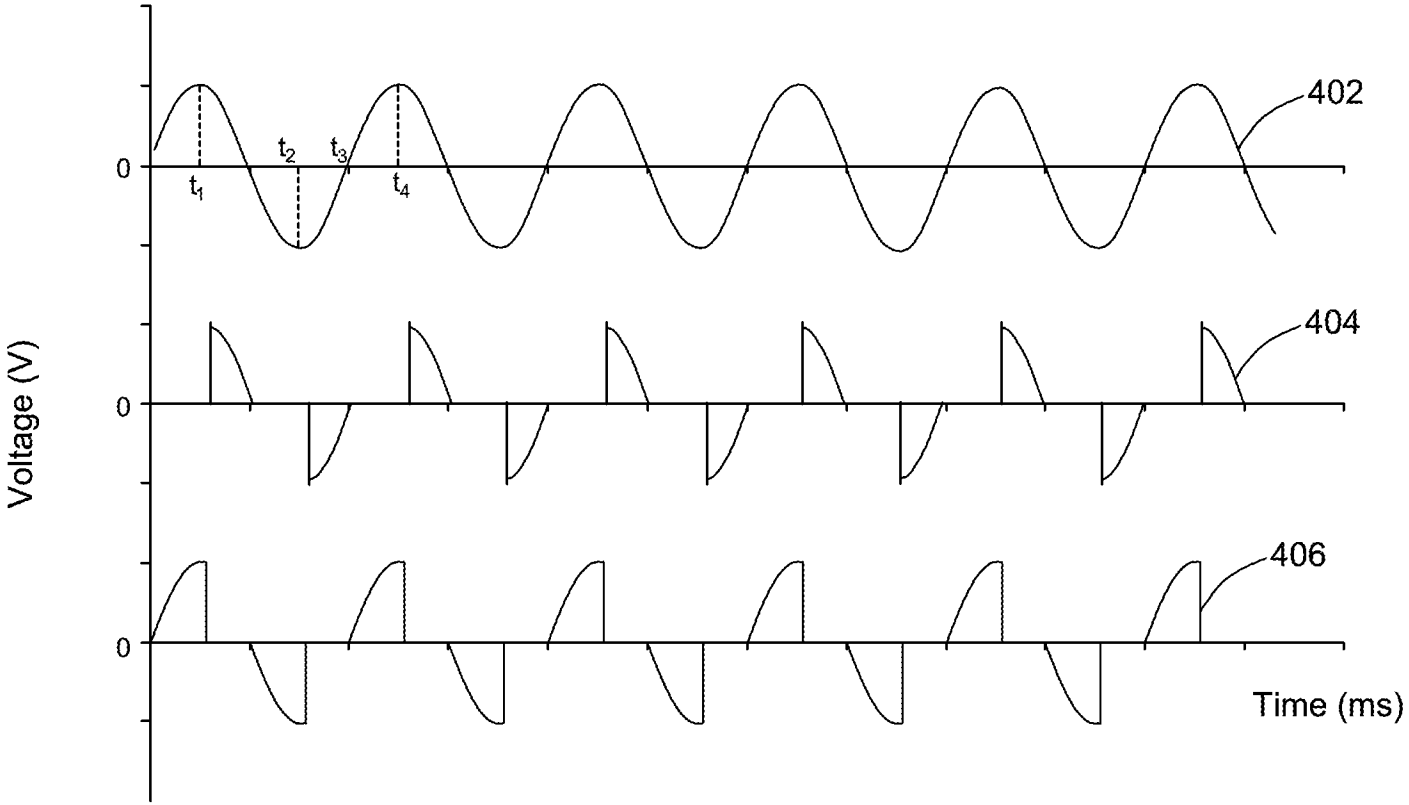
FIG. 4 is a schematic diagram of a waveform of an output voltage of an LED unit according to the present invention.

In some embodiments, the phase cut drive module 115 includes a leading-edge phase cut circuit. Referring to FIG. 1, FIG. 2 and FIG. 4 specifically illustrate how the temperature control module 105 of an embodiment achieves internal temperature control of the LED lamp 100 by using a leading-edge phase cut circuit.

FIG. 2 shows a circuit diagram of a first embodiment of an LED lamp. An LED lamp circuit 200 includes a magnetic ballast 203, a temperature control circuit 205, a rectifier circuit 207, a filtration circuit 209, and an LED unit module 211. The magnetic ballast 203 is configured to limit and stabilize an alternating current received from a source circuit 201. The rectifier circuit 207 and the filtration circuit 209 are configured to convert an alternating current into a direct current to output to the LED unit module 211. The temperature control circuit 205 is connected in parallel between the magnetic ballast 203 and the LED unit module 211, and configured to detect the internal temperature of the LED lamp and adjust a current transmitted to the LED unit module 211, so as to achieve the adjustability of the output power of the LED unit module 211. The LED unit module 211 includes at least one LED unit.

Figure 5:
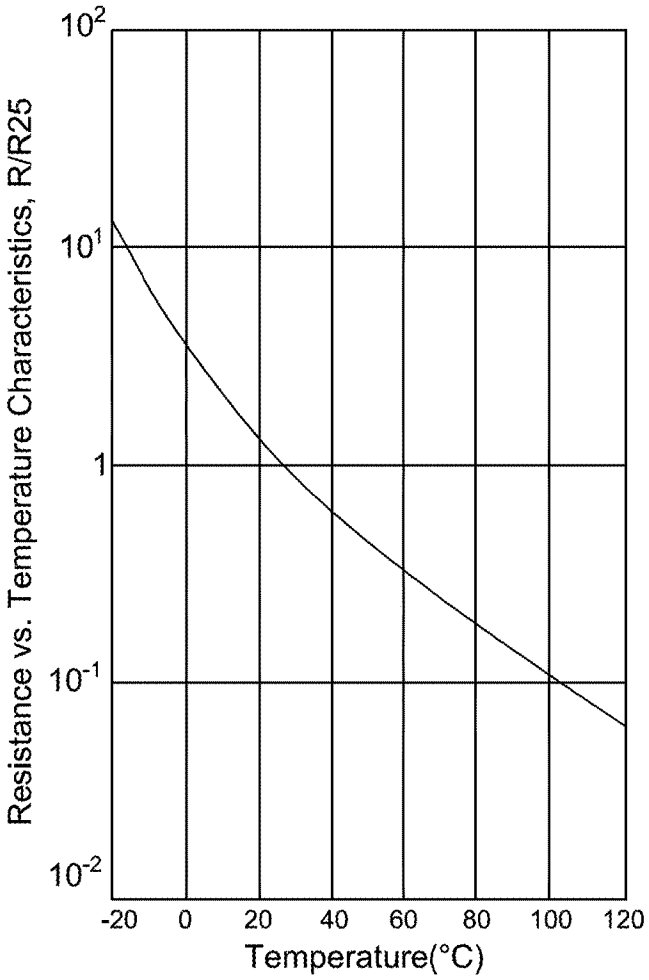
FIG. 5 is a curve of a ratio of a resistance of a negative temperature coefficient (NTC) thermistor to a resistance at 25 degrees Celsius varying with temperatures according to the present invention.

In this embodiment, the temperature control circuit 205 includes a thermal sensitive module 213, a leading-edge phase cut circuit 215, and a resistor $R_1$. The thermal sensitive module 213 is a negative temperature coefficient thermistor (NTC thermistor). A curve of a ratio of a resistance of the NTC thermistor to a resistance at 25 degrees Celsius varying with temperatures is shown in FIG. 5. In some embodiments, other models of NTC thermistor can be selected to meet the needs of different use conditions. The leading-edge phase cut circuit 215 is coupled to the thermal sensitive module 213 and includes a first switching transistor $Q_1$ and a first capacitor $C_1$. The first capacitor $C_1$, the NTC thermistor, and the resistor $R_1$ are connected in series and then coupled to two ends of the magnetic ballast 203, and a control terminal of the first switching transistor $Q_1$ is connected to common terminals of the first capacitor $C_1$ and the NTC thermistor. In some embodiments, the first switching transistor $Q_1$ is a silicon controlled device. The trigger electrode g of the silicon controlled device is a control terminal. The anode k and the cathode a of the silicon controlled device are coupled to two ends of the LED unit module 211, respectively.

In one embodiment, the temperature control circuit 205 is coupled to two ends of the magnetic ballast 203, that is, connected in parallel with the magnetic ballast 203. Since a magnetic ballast is different from an electronic ballast, a high-frequency current output by the electronic ballast may affect a service life of the first switching transistor Q1 connected in parallel or directly break down and damage the first switching transistor Q1, while a low-frequency current output by the magnetic ballast may not cause these effects.

FIG. 4 shows a schematic diagram of a waveform of an output voltage of an LED unit according to an embodiment. When the internal temperature of the LED lamp is lower than the specified temperature threshold, the resistance of the NTC thermistor is higher than a resistance threshold, the first switching transistor $Q_1$ is in an off state, and all currents output by the magnetic ballast 203 are transmitted to the LED unit module 211 after rectification and filtering. The waveform of the output voltage of the LED unit module 211 is shown as 402 in FIG. 4.

When the internal temperature of the LED lamp is higher than the specified temperature threshold, the resistance of the NTC thermistor is lower than the resistance threshold, voltages of two ends of the first capacitor $C_1$ are increased, such that the first switching transistor $Q_1$ is switched on. By means of the above adjustment, the current transmitted to the LED unit module 211 is reduced, that is, the output power of the LED unit module 211 is reduced, and the heat from the LED lamp and the internal temperature of the lamp are reduced accordingly. In this case, a diagram of a leading-edge phase cut waveform of the output voltage of the LED unit module 211 is shown as 404 in FIG. 4. Such repeated adjustments allow the internal temperature of the LED lamp to be maintained within a constant range, effectively preventing the service life of the LED unit from being reduced due to an excessively high temperature.

The resistor $R_1$ is configured to control the temperature threshold by using its different resistances. In addition, the resistor $R_1$ may also adjust the current distributed to the LED unit module 211 by using its different resistances, so as to control the output power of the LED unit module 211. In this embodiment, the temperature threshold is 100° Celsius.

As shown in FIG. 5, the resistance of the NTC thermistor decreases as the temperature increases, and is a smooth curve close to a straight line. In comparison, when the temperature exceeds a certain point (Curie temperature), the resistance of a positive temperature coefficient thermistor (PTC thermistor) increases stepwise as the temperature increases. When adjusting the output power of the LED unit module 211, the NTC thermistor ensures that the LED unit module 211 stably emits light without flickering. It should be noted that the thermistor may be a PTC thermistor.

Figure 3:
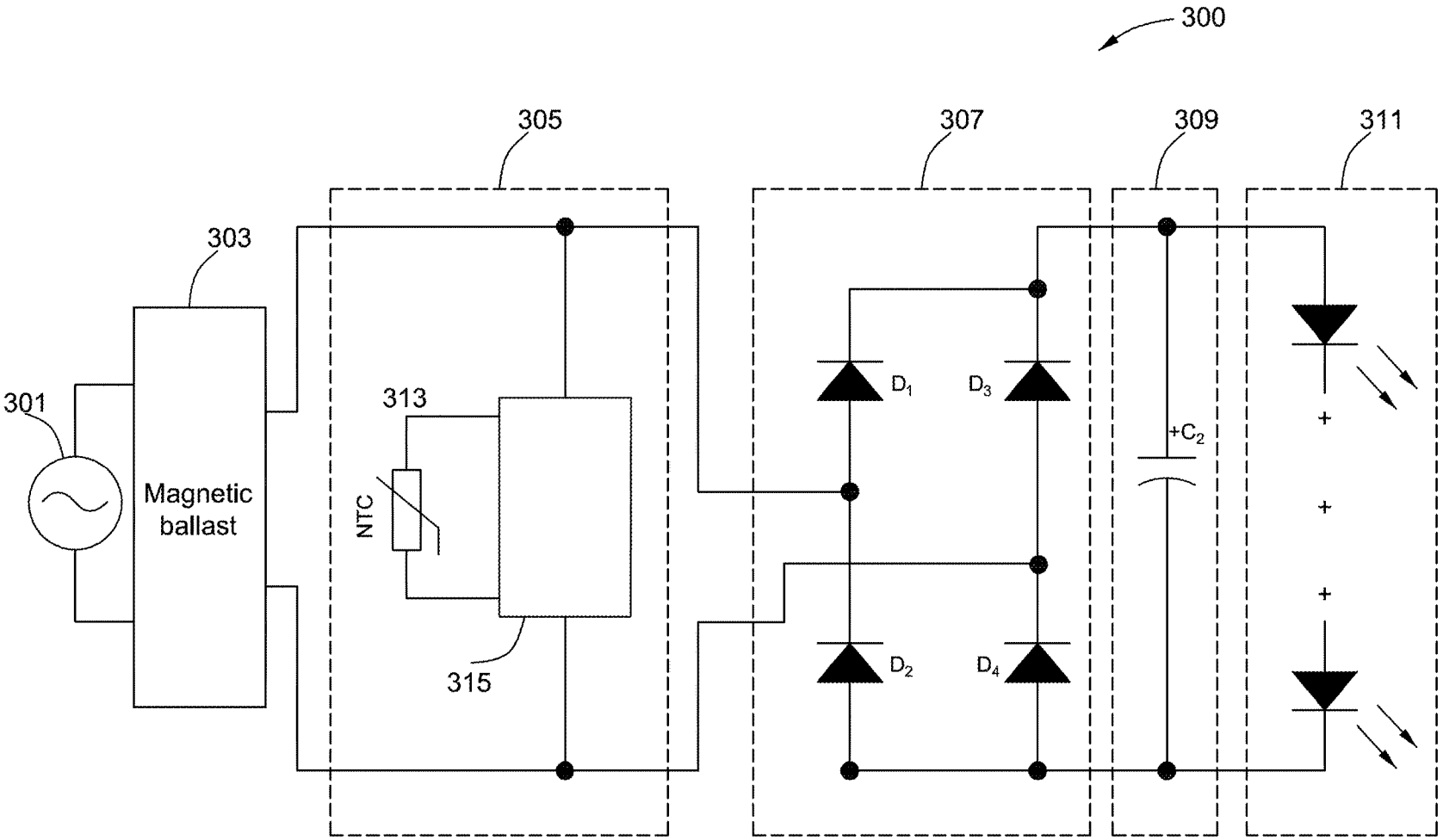
FIG. 3 is a circuit diagram of a second embodiment of an LED lamp according to the present invention.

In some embodiments, the phase-cut drive module 115 includes a trailing-edge phase-cut circuit. Referring to FIG. 1, FIG. 3 and FIG. 4 specifically illustrate how the temperature control module 105 of an embodiment achieves the internal temperature control of the LED lamp 100 by using a trailing-edge phase-cut circuit.

FIG. 3 shows a circuit diagram of a second embodiment of an LED lamp according to an embodiment. An LED lamp circuit 300 comprises a magnetic ballast 303, a temperature control circuit 305, a rectifier circuit 307, a filtration circuit 309, and at least one LED unit module 311. The magnetic ballast 303 is configured to limit and stabilize an alternating current received from a source circuit 301. The rectifier circuit 307 and the filtration circuit 309 are configured to convert an alternating current into a direct current to output to the LED unit module 311. The temperature control circuit 305 is connected in parallel between the magnetic ballast 303 and the at least one LED unit module 311, and is configured to detect the internal temperature of the LED lamp and adjust the current transmitted to the LED unit module 311. This achieves the adjustability of the output power of the LED unit module 311.

In this embodiment, the temperature control circuit 305 includes a thermo-sensitive module 313 and a trailing-edge phase-cut circuit 315. The thermo-sensitive module 313 is a negative temperature coefficient thermistor (NTC thermistor). The ratio curve of the resistance of the NTC thermistor to a resistance at 25° Celsius varying with temperatures is shown in FIG. 5. The trailing-edge phase-cut circuit 315 is coupled to the thermo-sensitive module 313. The trailing-edge phase-cut circuit 313 comprises a second switching transistor (not shown), which is a power-type metal-oxide-semiconductor field-effect transistor (MOSFET) or an insulated-gate bipolar transistor (IGBT) or the like. In some embodiments, the trailing-edge phase-cut circuit 313 may select any of the circuit connections known to those of ordinary skill in the art.

FIG. 4 shows a schematic diagram of an output voltage waveform of an LED unit according to an embodiment. When the internal temperature of the LED lamp is lower than the specified temperature threshold, the resistance of the NTC thermistor is higher than the resistance threshold, the trailing-edge phase-cut circuit 313 is in an off state, the circuit is operating normally, and all currents output by the magnetic ballast 303 are transmitted to the LED unit module 311 after rectification and filtering. The output voltage waveform of the LED unit module 311 is shown as 402 in FIG. 4.

When the internal temperature of the LED lamp is higher than the specified temperature threshold, the resistance of the NTC thermistor is reduced to be lower than the resistance threshold, such that the trailing-edge phase-cut circuit 313 is switched on to serve as a current divider. The current transmitted to the LED unit module 311 is reduced, that is, the output power of the LED unit module 311 is reduced, and the heat from the LED lamp and the internal temperature of the lamp are reduced accordingly. In this case, a diagram of a trailing-edge phase-cut waveform of the output voltage of the LED unit module 311 is shown as 406 in FIG. 4. Such repeated adjustments allow the internal temperature of the LED lamp to be maintained within a constant range, effectively preventing the service life of the LED unit from being reduced due to an excessively high temperature.

In the embodiments shown in FIG. 2 and FIG. 3, the rectifier circuits 207 and 307 include a bridge rectifier composed of four switching devices $D_1$, $D_2$, $D_3$, and $D_4$. The filtration circuits 209 and 309 include an electrolytic capacitor $C_2$. In other embodiments, the rectifier circuit and the filtration circuit may be other circuit connections known to those skilled in the art.

It can be seen from the above embodiments that, through the temperature control circuit in the drive circuit, the LED light source is directly driven by a magnetic ballast that drives a fluorescent light source or a high-pressure gas discharge light source, so as to achieve the purpose of controlling the LED output power and extending the service life of the lamp.

While the present invention has been described in detail with reference to specific embodiments thereof, it will be understood by those skilled in the art that many modifications and variations can be made to the present invention. It is therefore to be understood that the appended claims are intended to cover all such modifications and variations insofar as they are within the true spirit and scope of the invention.

The invention claimed is:

1. A LED lamp, comprising:

at least one LED unit; a magnetic ballast, coupled to a power and configured to transfer a received first alternating current to a first direct current; and a LED drive circuit, comprising a temperature control circuit coupled to the magnetic ballast and in parallel with the LED unit, configured to detect an internal temperature of the LED lamp and adjust an output power of the LED unit, wherein, the temperature control circuit comprises:

a thermal sensitive module, comprising a negative temperature coefficient thermistor; and a phase cut circuit coupled to the thermal sensitive module, wherein when the internal temperature of the LED lamp detected by the thermal sensitive module is higher than a temperature threshold, a resistance of the negative temperature coefficient thermistor is decreased to adjust the output power of the LED unit, wherein the phase cut circuit is configured to cut off a portion of a half cycle of an output voltage of the LED unit when the internal temperature of the LED lamp is higher than the temperature threshold.

2. The LED lamp according to claim 1, wherein the phase cut circuit is a lead phase cut circuit, comprising a first switch and a first capacitance, the first capacitance and the negative temperature coefficient thermistor are connected in series and coupled to two ends of the magnetic ballast, a control terminal of the first switch is connected to a common terminal of the first capacitance and the negative temperature coefficient thermistor.

3. The LED lamp according to claim 2, wherein when the internal temperature of the LED lamp increases, the resistance of the negative temperature coefficient thermistor is decreased, a control terminal voltage of the first switch is increased; when the internal temperature of the LED lamp is higher than the temperature threshold, the first switch is on, the current transferred to the LED unit is decreased to lower the output power of the LED unit.

4. The LED lamp according to claim 2, wherein the first switch is a thyristor, a trigger terminal of the thyristor is the control terminal of the first switch, and an anode and a cathode terminals of the thyristor are coupled to two ends of the LED unit, respectively.

5. The LED lamp according to claim 2, wherein the phase cut circuit further comprises a first resistance connected in series with the negative temperature coefficient thermistor, and the first resistance is configured to control the temperature threshold or the range of the output power of the LED unit.

6. The LED lamp according to claim 1, wherein the phase cut circuit is a trailing phase cut circuit, the trailing phase cut circuit and the negative temperature coefficient thermistor are connected in parallel and coupled to two ends of the magnetic ballast.

7. The LED lamp according to claim 6, wherein when the internal temperature of the LED lamp is higher than the temperature threshold, the resistance of the negative temperature coefficient thermistor is decreased to make the trailing phase cut circuit on, the current transferred to the LED unit is decreased to lower the output power of the LED unit.

8. The LED lamp according to claim 1, wherein the drive circuit further comprises a rectifier circuit and a filtration circuit connected in parallel and coupled between the temperature control circuit and the LED unit, the rectifier circuit and the filtration circuit are configured to transfer a second direct current to a second alternating current, the rectifier circuit and the filtration circuit comprise a rectifier bridge and an electrolytic capacitor connected in parallel.

9. A temperature control circuit, coupled between a magnetic ballast and at least one LED unit, wherein, the temperature control circuit comprises:

a thermal sensitive module, comprises a negative temperature coefficient thermistor; and a phase cut circuit is coupled to the thermal sensitive module, when the internal temperature of a LED lamp detected by the thermal sensitive module is higher than a temperature threshold, a resistance of the negative temperature coefficient thermistor is decreased to adjust the output power of the LED unit, wherein the phase cut circuit is configured to cut off a portion of a half cycle of an output voltage of the LED unit when the internal temperature of the LED lamp is higher than the temperature threshold.

10. A LED lamp, comprising:

at least one LED unit; a magnetic ballast, coupled to a power and configured to transfer a received first alternating current to a first direct current; and a LED drive circuit, comprising a temperature control circuit coupled to the magnetic ballast and in parallel with the LED unit, configured to detect an internal temperature of the LED lamp and adjust an output power of the LED unit, wherein, the temperature control circuit comprises:

a thermal sensitive module, comprising a negative temperature coefficient thermistor; and a phase cut circuit coupled to the thermal sensitive module, wherein when the internal temperature of the LED lamp detected by the thermal sensitive module is higher than a temperature threshold, a resistance of the negative temperature coefficient thermistor is decreased to adjust the output power of the LED unit, wherein the phase cut circuit is a trailing phase cut circuit, the trailing phase cut circuit and the negative temperature coefficient thermistor are connected in parallel and coupled to two ends of the magnetic ballast.

11. The LED lamp according to claim 10, wherein when the internal temperature of the LED lamp is higher than the temperature threshold, the resistance of the negative temperature coefficient thermistor is decreased to make the trailing phase cut circuit on, the current transferred to the LED unit is decreased to lower the output power of the LED unit.

12. The LED lamp according to claim 10, wherein the drive circuit further comprises a rectifier circuit and a filtration circuit connected in parallel and coupled between the temperature control circuit and the LED unit, the rectifier circuit and the filtration circuit are configured to transfer a second direct current to a second alternating current, the rectifier circuit and the filtration circuit comprise a rectifier bridge and an electrolytic capacitor connected in parallel.

* * * * *